US007213529B1

(12) United States Patent
McKain

(10) Patent No.: US 7,213,529 B1
(45) Date of Patent: May 8, 2007

(54) EMERGENCY SAIL SYSTEM

(76) Inventor: Paul C. McKain, 1300 Turkey Roost Ct., Tallahassee, FL (US) 32317

( * ) Notice: Subject to any disclaimer, the term of this patent is extended or adjusted under 35 U.S.C. 154(b) by 0 days.

(21) Appl. No.: 11/481,201

(22) Filed: Jul. 3, 2006

(51) Int. Cl.
*B63B 15/00* (2006.01)

(52) U.S. Cl. ..... 114/90; 114/102.1

(58) Field of Classification Search ..... 114/90, 114/102.1, 354
See application file for complete search history.

(56) References Cited

U.S. PATENT DOCUMENTS 2,351,275 A * 6/1944 McConnel ..... 403/305
4,016,823 A * 4/1977 Davis ..... 114/90
5,377,607 A * 1/1995 Ross ..... 114/39.12
6,189,472 B1 * 2/2001 Duncan ..... 114/102.16

* cited by examiner

*Primary Examiner*—Stephen Avila
(74) *Attorney, Agent, or Firm*—Robert M. Downey, PA

(57) ABSTRACT

An emergency sail system for disabled watercraft comprises a mast receptacle for interfacing with the watercraft structure and a multi-segmented main mast supported by the mast receptacle in a substantially vertical orientation and removable therefrom. A sail assembly is affixed to the main mast with a rotational joint wherein the sail assembly is rotatable about a vertical axis of the main mast in a first direction and is also rotatable about a horizontal axis substantially at right angles with respect to the main mast in a second direction.

20 Claims, 7 Drawing Sheets

EMERGENCY SAIL SYSTEM

BACKGROUND OF THE INVENTION

1. Field of the Invention

The present invention relates to sails for watercraft and more particularly to a temporary emergency sail for powered watercraft.

2. Discussion of the Related Art

In today's economy, powered watercraft have become more and more affordable as people have increasingly more disposable income for recreation. Consequently, powered watercraft have increased greatly in numbers and most especially in areas having large expanses of open water such as coastal areas. As with any mechanical apparatus, powered watercraft will fail at one time or another whether an engine failure or even merely running out of fuel. When such a failure occurs, the operator is often left with no means of returning to shore.

In a cases of emergency when the operator is unable to use the primary power system to return to shore, the operator must resort to other means. Some powered watercraft will have an auxiliary power source such as an outboard motor, but the vast majority of powered craft do not carry such auxiliary power. Others will have a two-way radio enabling them to call for assistance. But radios require electrical power, and if the primary power system is disabled, the available electrical power is limited to the existing battery which has a useful life limited to the current charge.

However, if such a watercraft is not so equipped, the operator must rely on another civilian craft or an official government vessel passing within close range to hear verbal pleas for assistance and then respond to the plea. Reliance on chance discovery of a watercraft in distress in such circumstances is dangerous at best and catastrophic at worst. Such reliance on chance discovery is increasingly dangerous as the size of the body of water increases. In the instance where the disabled craft is on the coastal regions of the ocean, albeit close to shore, even tidal forces and ocean currents can carry the disabled craft long distances in a short time.

Thus, what is desired is an alternate method of powering a disabled watercraft in an emergency wherein the alternate method is readily storable in the craft and easy to use.

SUMMARY OF THE INVENTION

One aspect of the present invention is an emergency sail system for disabled watercraft. The emergency sail system comprises a mast receptacle for interfacing with the watercraft structure and a multi-segmented main mast supported by the mast receptacle in a substantially vertical orientation and removable therefrom. A sail assembly is affixed to the main mast with a rotational joint wherein the sail assembly is rotatable about a vertical axis of the main mast in a first direction and is also rotatable about a horizontal axis substantially at right angles with respect to the main mast in a second direction.

Another aspect of the present invention is an emergency sail system for disabled watercraft comprising a mast receptacle for interfacing with the watercraft structure and a multi-segmented main mast having a plurality of like main mast elements wherein each main mast element has a coupler at one end thereof and receives an opposite end of a like main mast element. The main mast is coupled to and supported in a substantially vertical orientation by the mast receptacle and is removable therefrom. A sail assembly has a secondary mast and a horizontal boom that from a sail frame with a sail affixed to the sail frame. A bottom of the sail frame is interconnected to the main mast with rotational joint wherein the sail assembly is rotatable about a vertical axis of the main mast in a first direction and is also rotatable in a second direction about a horizontal axis substantially at right angles with the main mast. A top of the sail frame is affixed to the main mast with a resilient tension strap.

Yet another aspect of the present invention is an emergency sail system for disabled watercraft comprising a mast receptacle for interfacing with the watercraft structure and a multi-segmented main mast having a plurality of like main mast elements. Each main mast element has a coupler at one end thereof and receives an opposite end of a like main mast element. The main mast is coupled to and supported in a substantially vertical orientation by the mast receptacle and is removable therefrom. A sail assembly is interconnected to the main mast to be rotatable about a vertical axis of the main mast in a first direction and rotatable in a second direction about a horizontal axis substantially at right angles with said main mast. The sail assembly includes a sail frame having a secondary mast, a horizontal boom wherein said secondary mast and said horizontal boom are affixed one to the other at a pivot joint such that said secondary mast and said horizontal boom are pivotal from a position substantially parallel one to the other to a position wherein said secondary mast and said horizontal boom are at least at substantially right angles one with the other. A triangular sail is affixed to the sail frame wherein one corner of the sail is proximally affixed to the pivotal joint, one of the remaining sail corners is proximally affixed to an end of the secondary mast opposite from the pivotal joint and a last of the remaining sail corners is proximally affixed to an end of the horizontal boom opposite from the pivotal joint.

These and other advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 2:
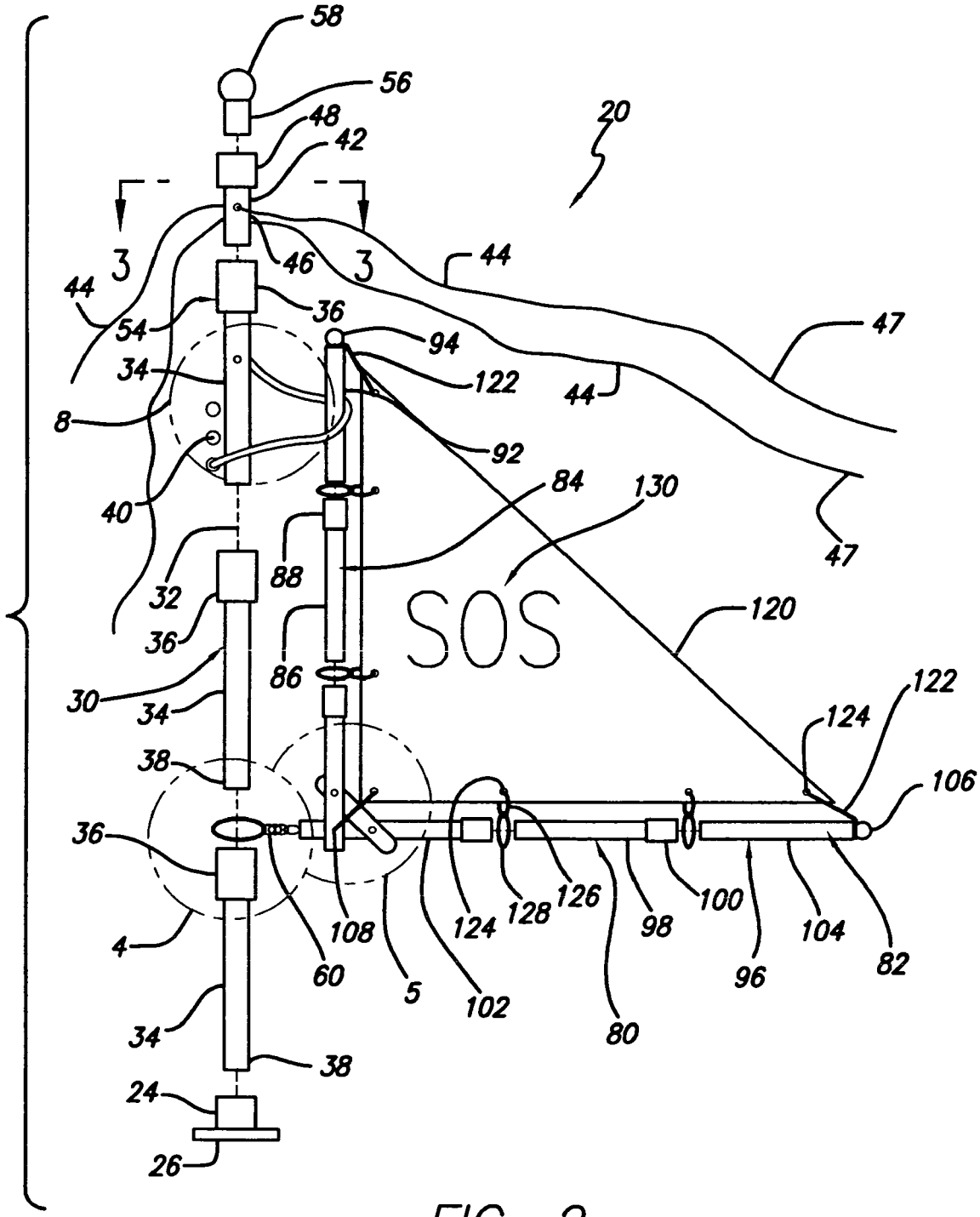
FIG. 2 is a partially exploded said elevational view of the emergency sail system.

For purposes of description herein, the terms "upper", "lower", "left", "rear", "right", "front", "vertical", "horizontal", and derivatives thereof shall relate to the invention as oriented in FIG. 2. However, one will understand that the invention may assume various alternative orientations and step sequences, except where expressly specified to the contrary. While the present has been shown and described in accordance with preferred and practical embodiments thereof, it is recognized that departures from the instant disclosure are fully contemplated within the spirit and scope of the invention. Hence, specific dimensions and other physical characteristics relating to the embodiments disclosed herein are not to be considered as limiting, unless the claims expressly state otherwise.

Figure 1:
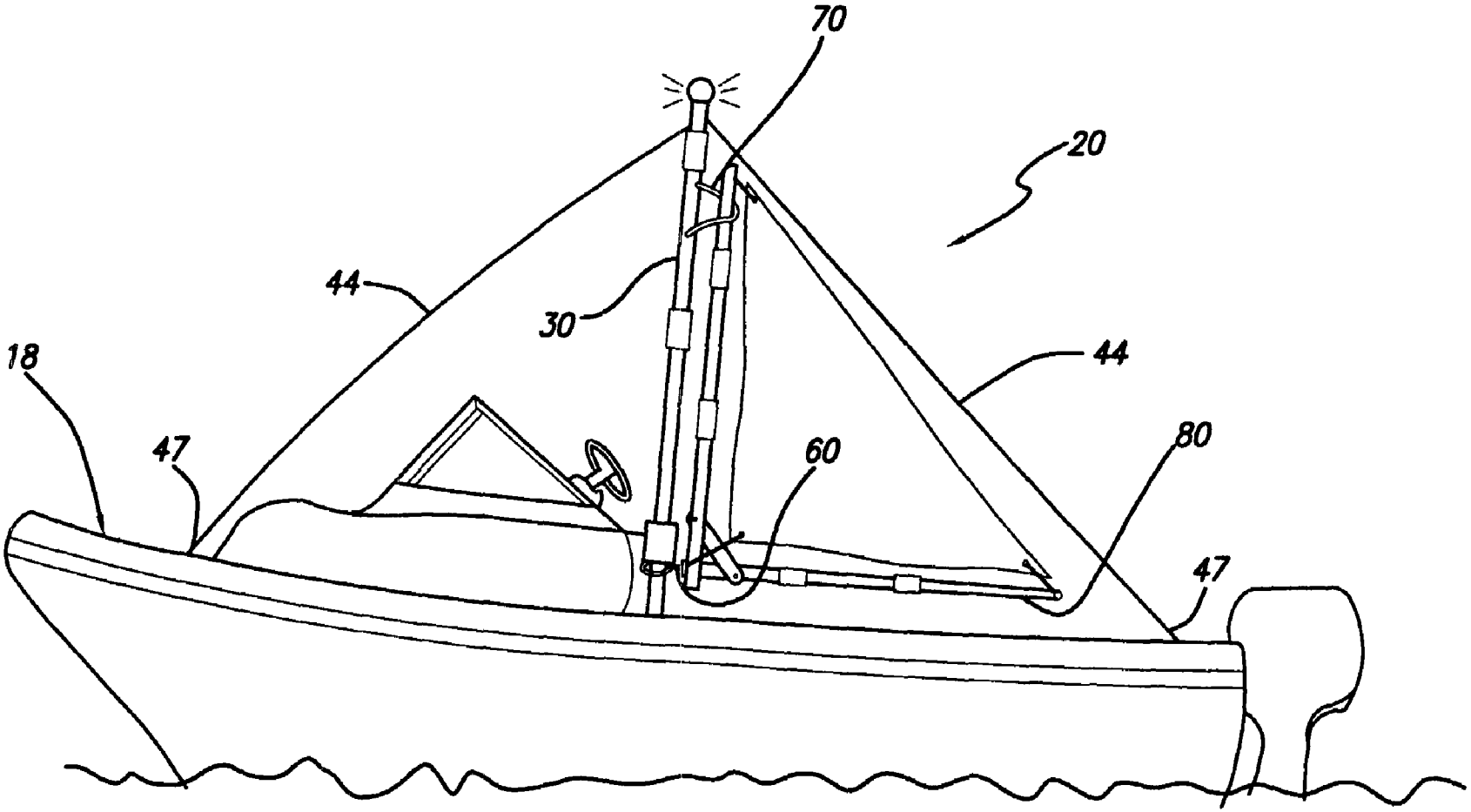
FIG. 1 is a side elevational view of a powered watercraft employing an emergency said system embodying the present invention.

Turning to the drawings, FIG. 1 shows a watercraft 18 employing an emergency sail system 20 which is one of the preferred embodiments of the present invention and illustrates its various components. Emergency sail system 20 is storable in watercraft 18 in a disassembled state and readily assembled in the event of an emergency such as when motorized watercraft 18 loses power and requires an alternate mode of propulsion to reach shore. When assembled, emergency sail system 20 has a mina mast 30 which is supported in a vertical position by stays 44 having ends 47 secured to watercraft 18. A sail assembly 80 is attached to main mast 30 with a rotatable joint 60 and a resilient tension strap 70.

Referring now to FIG. 2, main mast 30 has a plurality of individual main mast elements 34 which are telescopically stackable in an end-to-end configuration. Each main mast element 34 is generally of a tubular configuration with a coupler 36 affixed to one end thereof. Coupler 36 is sized to receive an opposite end 38 of a like main mast element 34 in a telescoping manner to form a rigid main mast 30. Main mast elements 34 are fabricated from a lightweight material which exhibits high strength such as aluminum, formable composites, or an extruded resinous material. Coupler 36 can also be integrally formed with the body of main mast element 34 or be provided as a separate part affixable to the body of main mast element 34.

Main mast 30 is supported on the watercraft 18 structure along a vertical axis 32 by mast receptacle 24 which telescopically receives an end 38 of a lowermost main mast element 34. A bottom 26 of mast receptacle 24 is affixed to a surface of the watercraft 18 structure with a high shear strength adhesive or double sided tape, or alternatively can be permanently mounted to the watercraft 18 structure with screws or bolts.

Figure 3:
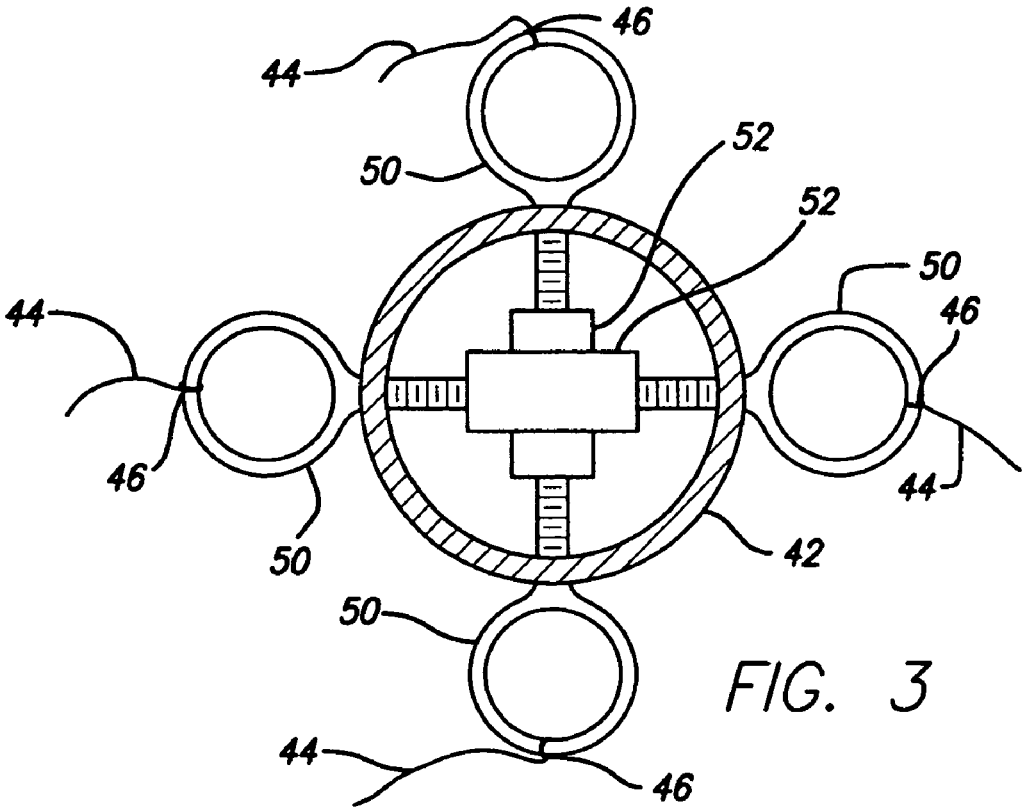
FIG. 3 is a cross-sectional view of a portion of the stay element of the main mast sown in FIG. 2 illustrating the attachment of the stays and taken along the line 3—3, FIG. 2.

Referring to FIGS. 2 and 3, a stay element 42 is received in a coupler 36 at mast top 54. A plurality of stays 44 are affixed about a perimeter of stay element 42. In the preferred embodiment and as illustrated most clearly in FIG. 3, four eyebolts 50 are equally positioned about stay element 42 at ninety degree intervals such that opposite ones of eyebolts 50 are aligned one with the other and are threaded into opposite ends of a barrel nut 52. An end 46 of each stay 44 is affixed to a respective eyebolt 50. When ends 47 of stays 44 (FIG. 1) are affixed to watercraft 18 and tensioned to maintain main mast 30 in a vertical orientation, the tensioning stress of opposite stays 44 are transferred along opposing eyebolts 50 and do not add any appreciable stress to the walls of stay element 42. Stay element 42 is typically constructed of the same material as main mast elements 34.

A coupler 48 is positioned at a top of stay element 42 and receives therein in a telescoping manner a strobe mount 56. Strobe mount 56 has mounted thereon a strobe light 58 for emitting a flashing light signal to draw attention to the distressed watercraft 18. Strobe mount 56 is readily removable from coupler 48 to permit the changing of batteries in the strobe light during extended periods of operation.

Referring to FIGS. 2, and 5–7, a sail assembly 80 has a sail frame 82 formed from a secondary mast 84 and a horizontal boom 96. Secondary mast 86 is comprised of a plurality of secondary mast segments 86 arranged in an end-to-end configuration and adjoined together by couplers 88. In the preferred embodiment, coupler 88 is integrally formed at an one end of secondary mast segment 86 so as to receive an opposite end of a like secondary mast segment in a telescoping manner. However, coupler 88 can be affixed to an end of secondary mast segment 86 or can be provided as an independent item. In like manner, horizontal boom 96 is comprised of a plurality of horizontal boom segments 98 of like construction interconnected in an end-to-end fashion by couplers 100.

Figure 5:
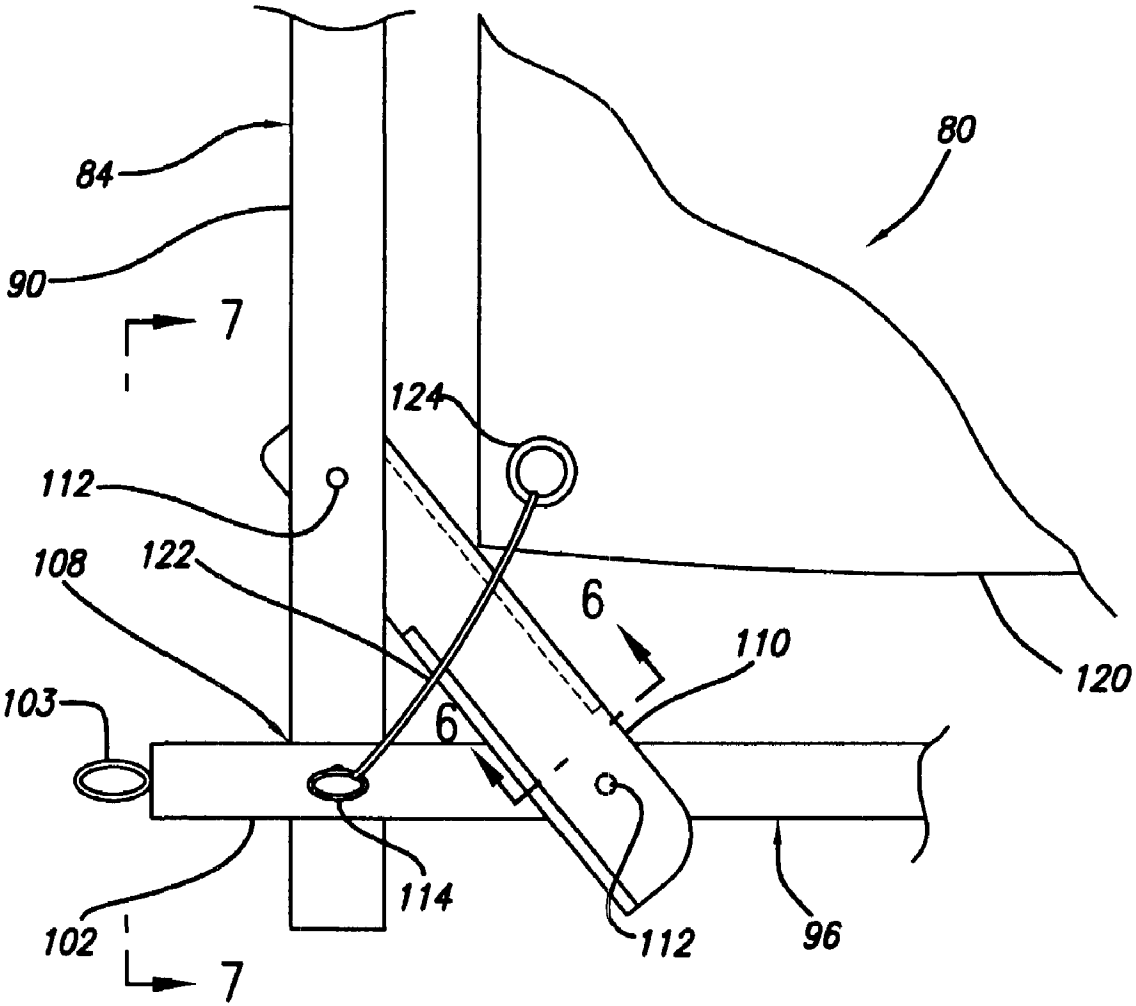
FIG. 5 is an enlarged view taken at 5 of FIG. 2 of the braced boom and secondary mast.
Figure 7:
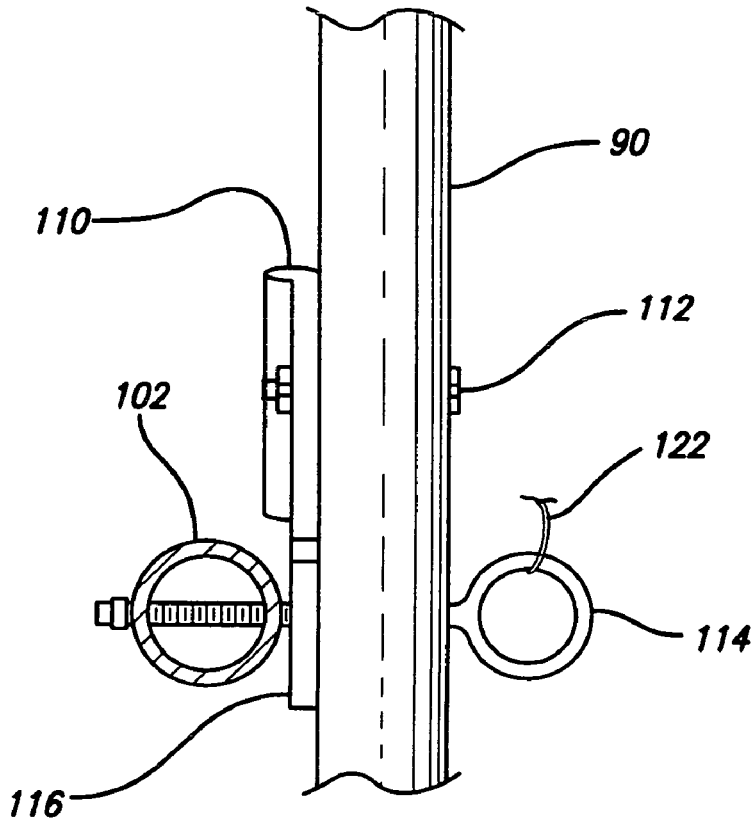
FIG. 7 is a partial elevational cross section of the braced boom and secondary mast assemblage in FIG. 5 and taken along the line 7—7, FIG. 5.

As illustrated in FIGS. 5 and 7, a first secondary mast segment 90 and a first horizontal boom segment 102 are pivotally affixed one to another with eyebolt 114 to form pivot joint 108. Pivot joint 108 permits secondary mast 84 and horizontal boom 96 to be pivoted to a mutually parallel relationship for storage. Also, in light of the segments nature of secondary mast 84 and horizontal boom 96, the individual segments can be disassembled such that only secondary mast first segment 90 and horizontal boom first segment 102 remain affixed one to the other and pivoted to a mutually parallel relationship. Horizontal boom first segment 102 includes an eyelet at an end proximate to the pivot joint and opposite from an end to which a coupler 100 is affixed.

Figure 6:
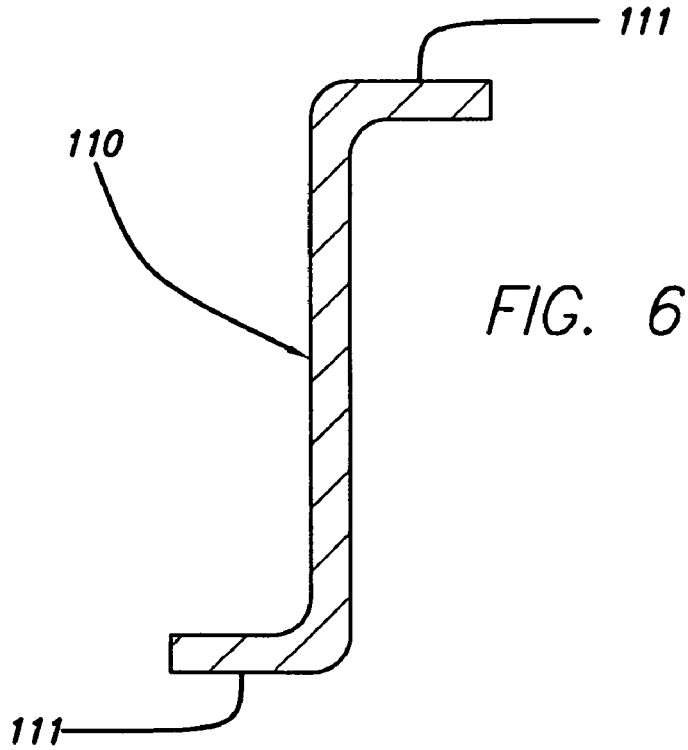
FIG. 6 is a cross section of the sail assembly brace shown in FIG. 5 and taken along the line 6—6, FIG. 5.

To maintain secondary mast 84 at a substantially right angle to horizontal boom 96, a brace 110 is affixed thereto proximate to pivot joint 108. A first bolt 112 or other similar fastener is used to secure one end of brace 110 to horizontal boom 96 and a second bolt 112 to secure an opposite end of brace 110 to secondary mast 84 thus forming a rigid triangular bracing configuration and maintaining secondary mast 84 and horizontal boom 96 at the perpendicular relationship. As shown in FIG. 6, brace 110 can be include stiffening flanges 111 to prevent brace 110 from buckling under the stresses induced by the sail assembly 80 in use. As shown in FIG. 7, a washer 116 is placed between horizontal boom first segment 102 and secondary mast first segment 90 at pivoting joint 108 to facilitate a smooth pivoting of joint 108. Washer 116 further acts a as a spacer approximately of equal thickness to brace 110 thereby facilitating correct alignment of brace 110 between secondary mast first segment 90 and horizontal boom first segment 102.

Referring again to FIGS. 2 and 5, a last secondary mast segment 92 includes an eyelet 94, and a last horizontal boom segment includes an eyelet 106. Eyelets 94 and 106 are located most distally form pivot joint 108. A triangular sail 120 is affixed to sail frame 82 by lines 122 securing a sail corner to eyelet 94 at a topmost end of secondary mast 84, to eyelet 106 at an end of horizontal boom 98 distal from pivot joint 108, and to eyelet 114 at pivot joint 108. Two edges of sail 120 have a plurality of eyelets 124 at regularly spaced intervals intermediate to the corners of sail 120. Each eyelets has a shackle 126 therethrough which in turn is affixed to a ring 128 encompassing either secondary mast 84 or horizontal boom 96 thereby securing sail 120 to secondary mast 84 and horizontal boom 96 at points intermediate to the corners of sail 120. Sail 120 is fabricated from suitable lightweight sail material and can be of a color such as bright orange which is associated with a vessel in distress. Additionally, sail 120 can also include a distress code 130 printed thereon to further visually convey a distress message to other craft in the vicinity. Alternately, a plain white sail 120 may also be used when the watercraft 18 is not in distress.

Figure 4:
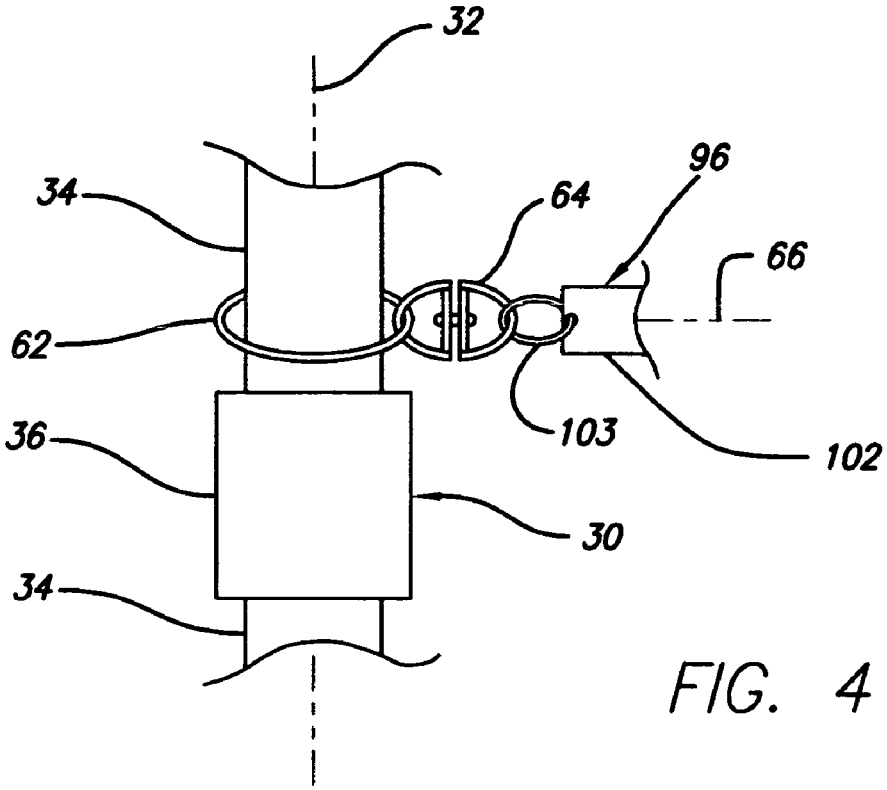
FIG. 4 is an enlarged view taken at 4 of FIG. 2 of the sail assembly swivel attachment to the main mast.

Referring now to FIG. 4, a rotatable joint 60 connects a bottom of sail assembly 80 to main mast 30. Rotatable joint 60 includes a ring 62 which encompasses main mast 30 preferably just above the lowermost main mast coupler 36. Ring 62 is free to rotate about main mast 30 and vertical axis 32. Alternatively, ring 62 can be loosely fitting sleeve rotatable about main mast 30. A swivel joint shackle 64, interconnects ring 62 to eyelet 103 at the end of horizontal boom first segment 102. Swivel joint shackle 62 includes opposing segments pivotable one with respect to the other such that horizontal boom 96 is free to pivot about horizontal axis 66. Thus, rotational joint 60 permits sail assembly 80 to rotate in two directions with respect to main mast 30.

Figure 8:
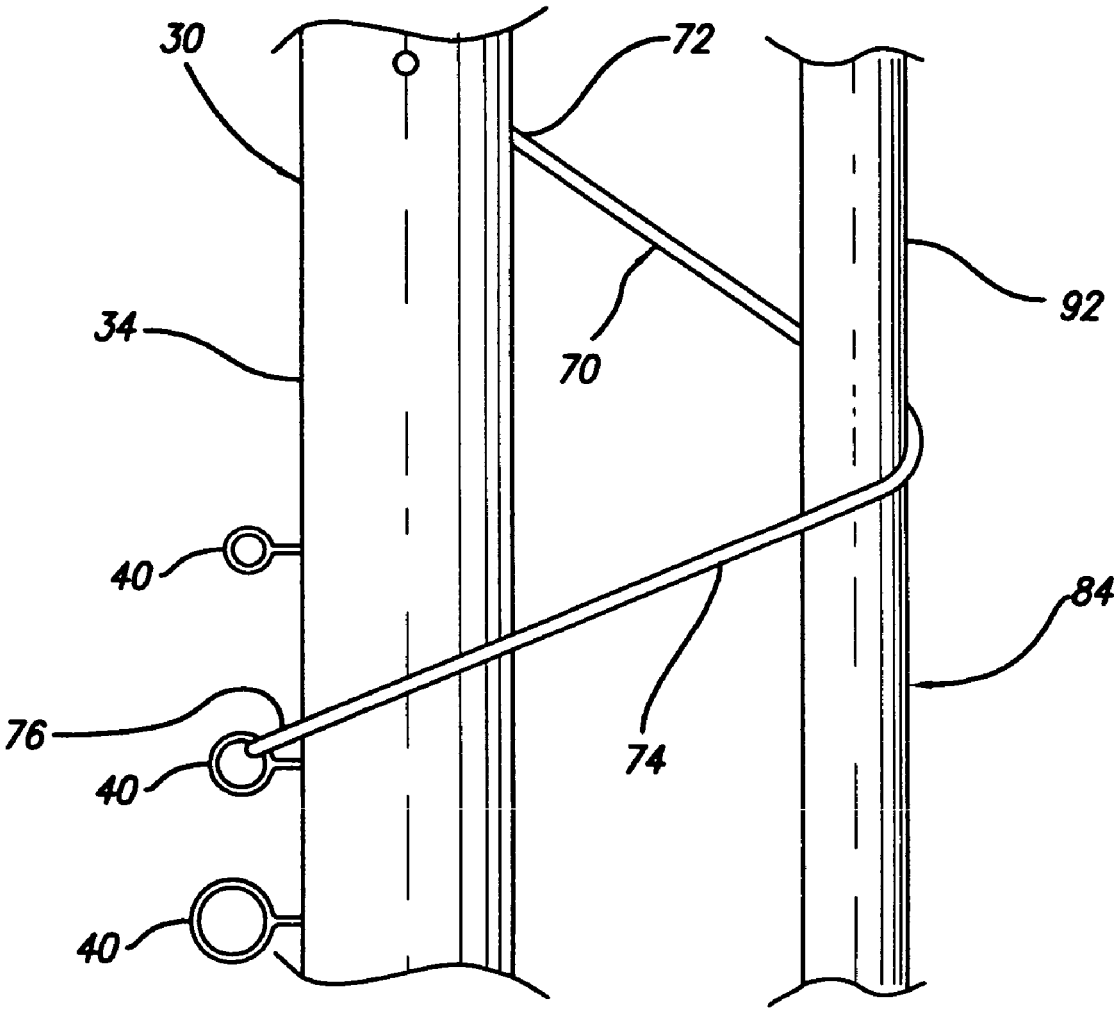
FIG. 8 is an enlarged view taken at 8 of FIG. 2 of the resilient tension strap securing the upper portion of the sail assembly to the main mast.

Looking now at FIG. 8, a last or uppermost segment 92 of secondary mast 84 is secured to an upper main mast element 34 of main mast 30 with resilient tension strap 70. Resilient tension strap 70 has a first end 72 affixed to the top of main mast 30 and its body 74 extends around topmost secondary mast segment 92. Main mast 30 includes a plurality of eyelets 40 in a vertically spaced arrangement. Second end 76 of resilient tension strap 70 is selectively connected to one of the eyelets 40. Resilient tension strap 70, in addition to being resilient to bending forces is also resilient along its longitudinal axis and is thereby longitudinally stretchable. AS resilient tensioning strap 70 is stretched to a greater degree, the longitudinal tension is increased thus requiring increased tension to stretch strap 70 further. Connection of second end 76 to an uppermost one of eyelets 40 results in the least pretension force in strap 70 while connection to a lowermost one of eyelets 40 results in the most pretension force in strap 70.

Figure 9:
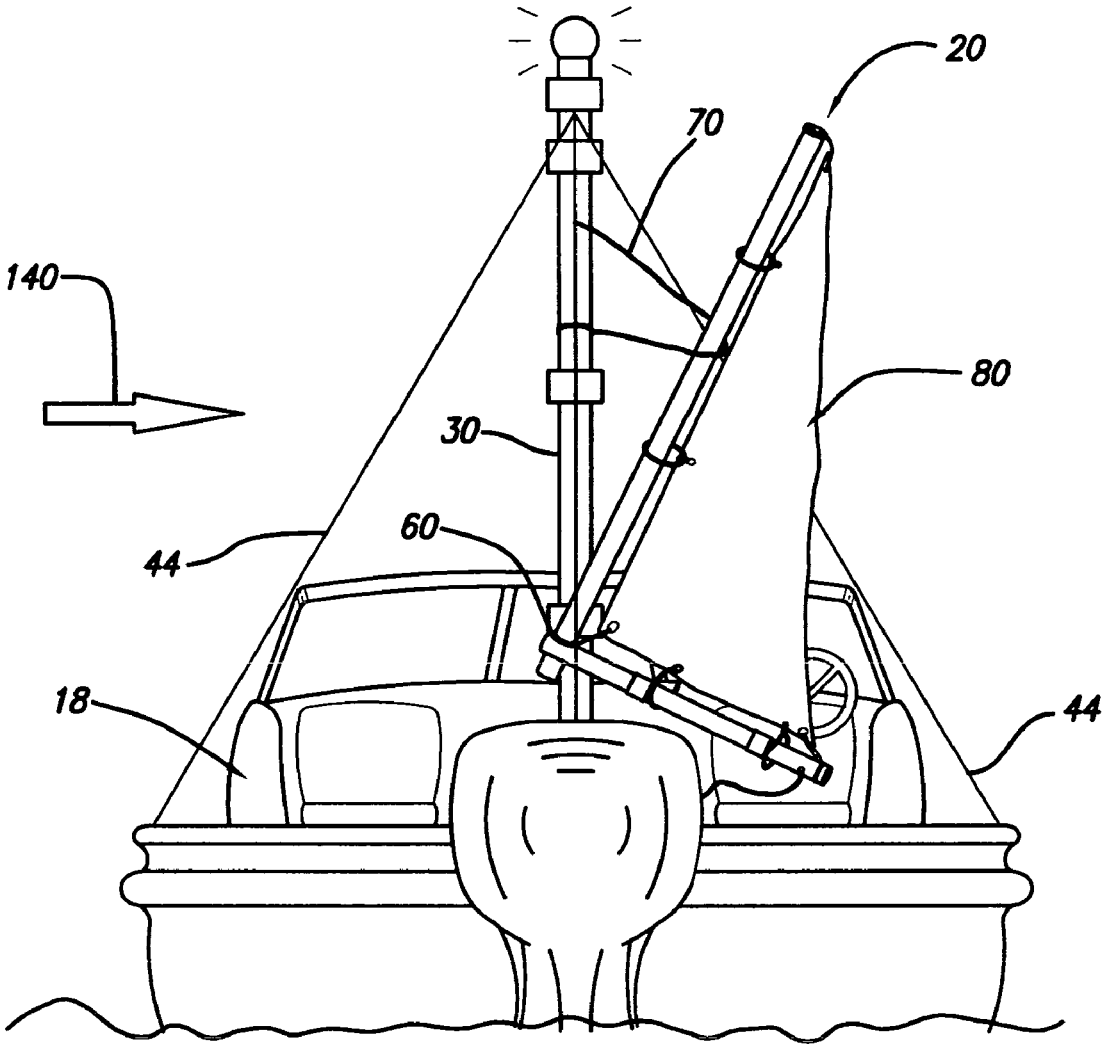
FIG. 9 is a rear elevational view of a powered watercraft employing the emergency sail system encountering a cross wind and illustrating the rotation of the sail assembly with respect to the main mast.

In use, as shown in FIGS. 1 and 9, a motorized watercraft is in distress. The main mast elements 34, stay element 42, and if desired strobe mount 56 are assembled to form main mast 30 and erected to a vertical position on the watercraft 18 structure. The bottom of main mast 30 is received in mast receptacle 24 previously secured to the watercraft 18 structure. Ends 47 of stays 44 are secured and tensioned to remote corners of the watercraft thereby securing the top of main mast 30. During assembly of main mast 30, ring 62 of rotatable joint 60 was telescoped over the appropriate one of main mast elements 34. Secondary mast segments 86, 90, and 92 are telescopingly received through rings 128 for attachment of sail 120 and interconnected with couplers 88 to form secondary mast 84. Horizontal boom segments 98, 102, and 104 are similarly interconnected with couplers 100 receiving thereover rings 128 to form horizontal boom 96. Horizontal boom 96 and secondary mast 84 are pivoted about pivot joint 108 to a perpendicular relationship whereupon brace 110 is affixed therebetween with bolts 112 to maintain the desired perpendicular relationship. Sail 120 is secured to rings 128 with shackles 126 and at each corner thereof lines 122 further secure sail 120 to eyelets 94, 106, and 114. Resilient tensioning strap 70 is extended about the upper segment 92 of secondary mast 84 and end 76 thereof is connected to a desired one of eyelets 40 on main mast 30.

Upon final assembly of emergency sail system 20, disabled watercraft 18 can be directed to shore by the propulsive force of sail 120. Watercraft 18 is steered by utilizing the existing steering mechanism of watercraft 18 such as by a rudder (not shown) or an outdrive (not shown) of the disabled motorized propulsion system. Since users of motorized watercraft are not typically experienced in the use of a sail, encountering a cross wind 140 as shown in FIG. 9 can potentially create a hazardous situation. However, the rotational joint 60 securing the bottom of sail assembly 80 to main mast 30 in cooperation with the resilient tensioning strap 70 securing the top of sail assembly to main mast 30 permit sail assembly 80 to rotate about a horizontal axis 66 (FIG. 4) and allow the cross wind to spill out of sail assembly 80 prior to capsizing watercraft 18 or subjecting emergency sail system to overstressing forces. The degree of desired wind spillage is controlled by the selected eyelet 40 on main mast 30 to which end 76 of tensioning strap 70 is connected.

In the foregoing description those skilled in the art will readily appreciate that modifications may be made to the invention without departing from the concepts disclosed herein. Such modifications are to be considered as included in the following claims, unless these claims expressly state otherwise.

I claim:

1. An emergency sail system for disabled watercraft, said emergency sail system comprising:

a mast receptacle for interfacing with the watercraft structure;

a main mast supported by said mast receptacle in a substantially vertical orientation and removable therefrom;

a sail assembly;

a rotational joint affixing said sail assembly to said main mast and said rotational joint being structured and disposed for allowing said sail assembly to rotate in a first direction about a vertical axis of said main mast; and a swivel joint structured and disposed for allowing said sail assembly to rotate in a second direction about a horizontal axis substantially at right angles with said main mast.

2. The emergency sail system according to claim 1 wherein said main mast comprises a multi-segmented assembly including a plurality of like main mast elements, each said main mast element having a coupler at one end thereof and receiving an opposite end of a like main mast element, and further wherein said main mast couples in like manner with said mast receptacle.

3. The emergency sail system according to claim 2 further comprising a stay element, said stay element coupling with a topmost end of said main mast, said stay element including a plurality of stays about a periphery thereof with a first end of each said stay affixed to said stay element and a second end of each said stay for attachment to the watercraft structure for stabilizing a top of said main mast.

4. The emergency sail system according to claim 3 wherein said stay elements includes a plurality of eyelets about a periphery thereof and wherein one of said stays is affixed to an eyelet, each of said eyelets affixed to a like eyelet substantially directly opposite therefrom such that upon tensioning said stays, said tensioning force of a first stay is directly opposed by an opposite tensioned stay through said oppositely affixed eyelets.

5. The emergency sail system according to claim 4 wherein:

said stay element includes a coupler at a topmost end; and wherein said emergency sail system further comprises:

a strobe mount removable received in said stay element coupler; and a strobe light affixed to said strobe mount for generating a flashing light beam.

6. The emergency sail system according to claim 1 wherein said sail assembly comprises:

a sail frame including a secondary mast and a horizontal boom wherein said secondary mast and said horizontal boom are affixed one to the other at a pivot joint such that said secondary mast and said horizontal boom are pivotal from a position substantially parallel one to the other to a position wherein said secondary mast and said horizontal boom are at least at substantially right angles one with the other; and a triangular sail affixed to said sail frame wherein a first corner of said sail is proximately affixed to said pivotal joint, a second sail corner is proximally affixed to an end of said secondary mast opposite from said pivotal joint and a third sail corner is proximally affixed to an end of said horizontal boom opposite from said pivotal joint.

7. The emergency sail system according to claim 6 wherein said sail frame further includes a brace, one end of said brace affixed to said secondary mast and a second end thereof affixed to said horizontal boom, said brace substantially maintaining said secondary mast and said horizontal boom at a right angle one with the other.

8. The emergency sail system according to claim 6 wherein said sail is colored in a highly visible color associated with a signal of distress such as a high visibility orange.

9. The emergency sail system according to claim 8 wherein said sail further includes a distress code printed thereon.

10. The emergency sail system according to claim 6 wherein said rotatable joint affixing said sail assembly to said main mast comprises a ring telescopically received over said main mast and rotatable about a vertical axis.

11. The emergency sail system according to claim 10 wherein said swivel joint includes is a swivel jointed shackle affixed to said ring.

12. The emergency sail system according to claim 6 further including a resilient tension strap affixing a top of said sail from to said main mast.

13. The emergency sail system according to claim 12 wherein said resilient tension strap has a first end affixed to said main mast, a body extending around an upper portion of said secondary mast and a second end affixed to a tensioning eye on said main mast.

14. The emergency sail system according to claim 13 wherein said main mast includes a plurality of vertically spaced tensioning eyes, and further wherein said second end of said resilient tensioning strap is selectively repositionable to any one of said tensioning eyes such that a desired pre-tension is selectable by affixing said second end of said resilient tension strap to a corresponding one of said plurality of tensioning eyes.

15. The emergency sail system according to claim 6 wherein:

said secondary mast comprises a plurality of secondary mast segments joined in end-to-end fashion, adjacent ones of said secondary mast segments joined by a coupler;

said horizontal boom comprises a plurality of horizontal boom segments joined in end-to-end fashion, adjacent ones of said horizontal boom segments joined by a coupler; and further wherein:

a first secondary mast segment and a first horizontal boom segment are affixed one to the other to form said pivot joint; and a last secondary mast segment and a last horizontal boom segment each include an eyelet at an end most distal from said pivot joint for securing a respective corner of said triangular sail.

16. An emergency sail system for disabled watercraft, said emergency sail system comprising:

a mast receptacle for interfacing with the watercraft structure;

a multi-segmented main mast having a plurality of like main mast elements, each said main mast element having a coupler at one end thereof and receiving an opposite end of a like main mast element, said main mast coupled to and supported in a substantially vertical orientation by said mast receptacle and removable therefrom;

a sail assembly having a secondary mast and a horizontal boom forming a sail frame, and a sail affixed to said sail frame;

a rotational joint affixing a bottom of said sail frame to said main mast wherein said sail assembly is rotatable about a vertical axis of said main mast in a first direction and is also rotatable in a second direction about a horizontal axis substantially at right angles with said main mast; and a resilient tension strap affixing a top of said sail frame to said main mast.

17. The emergency sail system according to claim 16 wherein said rotatable joint affixing said sail frame to said main mast comprises:

a ring telescopically received over said main mast and rotatable about a vertical axis thereof; and a swivel jointed shackle affixing said ring to an end of said horizontal boom proximate to said pivot joint such that said horizontal boom is rotatable about a longitudinal axis when affixed to said ring.

18. The emergency sail system according to claim 17 wherein said resilient tension strap has a first end affixed to said main mast, a body extending around an upper portion of said secondary mast and a second end affixed to a tensioning eyelet on said main mast.

19. The emergency sail system according to claim 18 wherein said main mast includes a plurality of vertically spaced tensioning eyes, and further wherein said second end of said resilient tensioning strap is selectively repositionable to any one of said tensioning eyelets such that a desired pre-tension is selectable by affixing said second end of said resilient tension strap to a corresponding one of said plurality of tensioning eyelets.

20. An emergency sail system for disabled watercraft, said emergency sail system comprising:

a mast receptacle for interfacing with the watercraft structure;

a multi-segmented main mast having a plurality of like main mast elements, each said main mast element having a coupler at one end thereof and receiving an opposite end of a like main mast element, said main mast coupled to and supported in a substantially vertical orientation by said mast receptacle and removable therefrom; and a sail assembly affixed to said main mast, said sail assembly rotatable about a vertical axis of said main mast in a first direction and rotatable in a second direction about a horizontal axis substantially at right angles with said main mast, said sail assembly including a sail frame having a secondary mast and a horizontal boom wherein said secondary mast and said horizontal boom are affixed one to the other at a pivot joint such that said secondary mast and said horizontal boom are pivotal from a position substantially parallel one to the other to a position wherein said secondary mast and said horizontal boom are at least at substantially right angles one with the other and also including a triangular sail affixed to said sail frame wherein a first corner of said sail is proximally affixed to said pivotal joint, a second of said sail corners is proximally affixed to an end of said secondary mast opposite from said pivotal joint and a third of said sail corners is proximally affixed to an end of said horizontal boom opposite from said pivotal joint.

* * * * *